United States Patent [19]

Juei Jse

[11] Patent Number: 4,567,084

[45] Date of Patent: Jan. 28, 1986

[54] MULTILAYERED CORRUGATED ROOFING

[76] Inventor: Lin Juei Jse, 4th Fl., No. 37-39, Sec. 2, Shih Chuan Rd., Panchiao City, Taiwan

[21] Appl. No.: 588,943

[22] Filed: Mar. 12, 1984

[51] Int. Cl.[4] ..... D06N 7/04; B32B 3/28; B32B 3/30; B05D 3/02

[52] U.S. Cl. ..... 428/150; 52/309.17; 52/537; 52/795; 106/286.6; 106/287.1; 427/397.7; 428/182; 428/268; 428/428; 428/443

[58] Field of Search ..... 52/309.17, 537, 795; 428/150, 182, 268, 428, 443; 501/123, 124; 106/286.6, 287.1; 427/397.7

[56] References Cited

U.S. PATENT DOCUMENTS 4,287,241 9/1981 Kaufmann ..... 52/309.17 X

FOREIGN PATENT DOCUMENTS 0056387 4/1982 Japan ..... 428/182

*Primary Examiner*—Michael R. Lusignan

*Attorney, Agent, or Firm*—Jeffers, Irish & Hoffman

[57] ABSTRACT

A multilayered corrugated roofing which comprises a corrugated heat proof substrate and an overlaying layer formed of a coherent substance constituted of dolomite, magnesite, white cement and water. Serpentine or calcite may also be incorporated with the above constituents. Either roasted or unroasted dolomite or magnesite can be used.

16 Claims, 2 Drawing Figures

MULTILAYERED CORRUGATED ROOFING

BACKGROUND OF THE INVENTION

This invention relates to heatproof substances, particularly to a novel corrugated heatproof roofing.

Conventionally, there have existed corrugated roofings, such as plastic corrugated board, corrugated asbestos roofing etc. Among them, corrugated asbestos roofing is a major roofing used for heat-resisting, weather resisting purposes.

However, both corrugated asbestos roofing and other plastic corrugated boards reinforced with fibrous materials, such as, rags, glass fibers or asbestos merely offer a temporary heat resisting effect. After subjected to the sun light for a period, the temperature in the indoor space will be increased.

Generally, these roofings are made of low heat conducting materials which have poor heat-reflecting characteristics. The major component, asbestos, in the corrugated asbestos roofing has a low thermal conductivity of about 0.087 Btu/(hr)(ft) (F). Its thermal absorptivity is high, generally up to 0.96. It absorbs the radiating heat emitted from the sun and therefore the temperature thereof gradually increases. When the heat input and heat output of the roofing are in equilibrium, the temperature thereof become constant. At that time, the roofing has already emitted its absorbed heat into the indoor space. When the sunlight disappears, the absorbed heat of the roofing may still be transferred to the indoor space. Therefore, the temperature in the indoor space still remains high.

The inventor found that, to improve the heat resisting effect of corrugated asbestos roofing, it is necessary (a) to make multilayer roofing, (b) to reduce the heat absorptivity of the roofing and (c) to increase the reflectivity of the roofing.

SUMMARY OF THE INVENTION

An object of the invention is to provide a multilayered corrugated roofing which can offer an excellent heat resisting effect.

The foregoing and other objects of the invention can be achieved in accordance with the invention through the provision of a multilayered corrugated roofing which comprises a corrugated heatproof substrate and an overlaying layer formed of a coherent substance constituted of dolomite, magnesite, white cement and water. Alternatively, the coherent substance used to form the overlaying layer may further include serpentine or calcite.

The above-described overlaying layer is an excellent heatproof substance which has low thermal conductivity, low heat absorptivity and a high reflective index. There are heat reflexible crystalline substances formed in the overlaying layer. Preferably, the amount of white cement used is to be $\frac{1}{3}$ of the total amount of the mixture. Dolomite and magnesite may or may not be roasted. The ratio of unroasted to roasted dolomite or the ratio of unroasted or roasted magnesite contained in the mixture is preferably 1:3. Dolomite and magnesite are white colour and rhombohedral system crystalline substances. The reflective indexes of the dolomite and magnesite are respectively 1.68 n and 1.70 n. Accordingly, they can offer excellent reflecting effects. Serpentine is a monoclinic system crystalline substance and its reflective index is 1.55 n. Calcite is a rhombohedral system crystalline substance and its reflective index is 1.66 n. They are also good heat reflective substances.

Furthermore all are low thermal conductivity materials. Dolomite $Mg(CaCO_3)2$, after roasted may decompose into Calcium oxide, magnesium oxide and Carbon dioxide, and magnesite $MgCO_3$, after roasted, may decompose into magnesium oxide and carbon dioxide. Magnesium oxide and calcium oxide are low heat-absorbing and low heat-conducting compounds. Carbon dioxide will escape and thus increase the porosity of the formed coherent substance. Therefore, the substance formed of dolomite and magnesite has an excellent heatproofing characteristic.

The presently preferred exemplary embodiment will be described in detail with reference to the following drawings, wherein:

DETAILED DESCRIPTION OF THE PREFERRED EMBODIMENT

Figure 1:
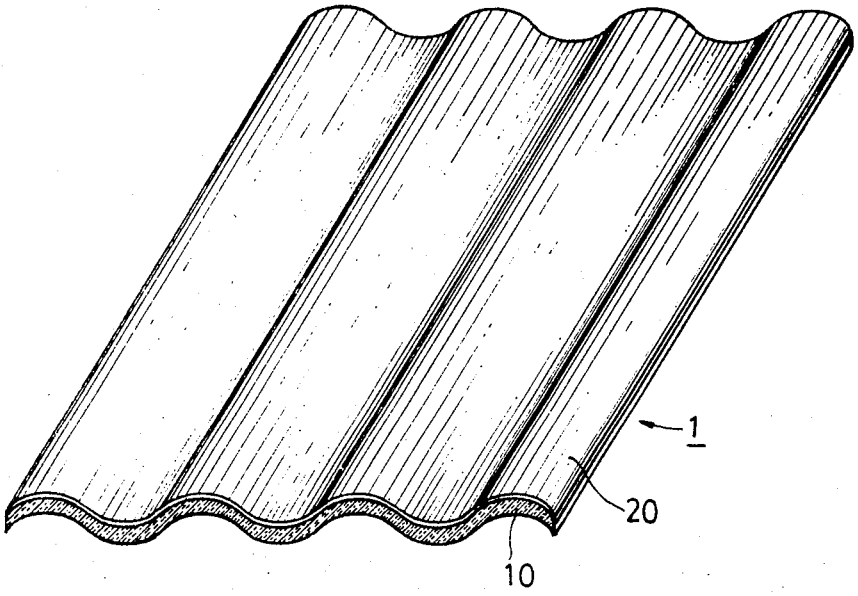
FIG. 1 is a perspective view of a corrugated roofing constructed according to the invention.

Referring to the drawings, there is shown corrugated roofing 1 which includes a substrate 10 and an overlaying layer 20. The substrate 10 is a corrugated board made of resin impregnated glass fibers and asbestos.

The layer 20 is made from dolomite, magnesite, white cement and water which are mixed in a ratio of 1:1:1. Either roasted or unroasted dolomite or magnesite can be used in the invention. The mixture may contain roasted and/or unroasted dolomite and roasted and/or unroasted magnesite. After they are mixed, the mixture is overlayed and formed into a coherent substance on the substrate 10.

Figure 2:
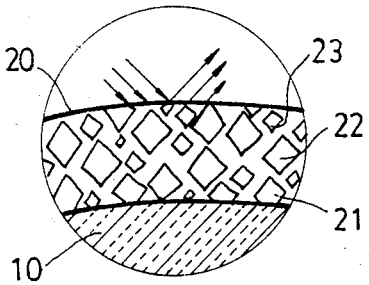
FIG. 2 is an enlarged view showing a portion of the same roofing.

FIG. 2 is an enlarged sectional view illustrating a portion of the roofing in which numeral 21 represents dolomite crystals which are 30 percent of the total dolomite used, and numeral 22 represents magnesite crystals which are 30 percent of the total magnesite used. The remaining 70 percent dolomite or magnesite are roasted dolomite and magnesite. Numeral 23 represents the coherent mass of dolomite, magnesite and white cement.

When the roofing 1 is subjected to the sunlight, dolomite and magnesite crystals reflect the radiation rays from the sun and the formed porous coherent substance of dolomite, magnesite and white cement which is low in thermal conductivity and thermal absorptivity exhibits an excellent heatproofing characteristic.

Table 1 shows the data comparing the outdoor and indoor temperatures obtained from a test using the roofing 1.

TABLE 1

| | | | | | |
|---|---|---|---|---|---|
| BUILDING 1 | | | | | |
| TIME (o'clock) | 10:00 | 12:00 | 14:00 | 16:00 | 18:00 |
| OUTDOOR TEMP. (°C.) | 26 | 27.5 | 35 | 33.2 | 25 |
| 1st FL. TEMP. (°C.) | 21.5 | 22 | 24 | 24.1 | 23 |
| 3rd FL. TEMP. (°C.) | 21.5 | 22 | 22.8 | 23 | 23 |
| BUILDING 2 | | | | | |
| TIME (o'clock) | 10:00 | 12:00 | 14:00 | 16:00 | 18:00 |
| OUTDOOR TEMP. (°C.) | 27.5 | 28 | 35.5 | 35.5 | 28 |
| 1st FL. TEMP. (°C.) | 22.6 | 24.8 | 24.5 | 23.8 | 23 |
| 3rd FL. TEMP. (°C.) | 22.6 | 24.5 | 24.8 | 25.5 | 24 |
| BUILDING 3 | | | | | |
| TIME (o'clock) | 10:00 | 12:00 | 14:00 | 16:00 | 18:00 |
| OUTDOOR TEMP. (°C.) | 28 | 38 | 39 | 39.8 | 31 |

TABLE 1-continued

| | | | | | |
|---|---|---|---|---|---|
| 1st FL. TEMP. (°C.) | 24 | 24.8 | 25.2 | 25.8 | 26 |
| 3rd FL. TEMP. (°C.) | 24 | 24.5 | 24.8 | 26.3 | 26.3 |

With the invention thus explained, it is apparent that obvious modifications and variations can be made without departing from the scope of the invention. It is therefore intended that the invention be limited only as indicated in the appended claims.

I claim:

1. A multilayered corrugated roofing comprising:
a corrugated heat proof substrate; and
an exterior layer of a coherent substance on the top surface of said substrate, said dried substance constituted of effective amounts of dolomite, magnesite, and white cement.

2. A multilayered corrugated roofing as claimed in claim 1, wherein said substrate is a corrugated board made of resin impregnated glass fiber and asbestos.

3. A multilayered corrugated roofing as claimed in claim 1, wherein said coherent substance includes roasted dolomite.

4. A multilayered corrugated roofing as claimed in claim 1, wherein said coherent substance includes roasted magnesite.

5. A multilayered corrugated roofing as claimed in claim 1, wherein said coherent substance further includes serpentine.

6. A multilayered corrugated roofing as claimed in claim 1, wherein said coherent substance further includes calcite.

7. A method of making a multilayer corrugated roofing comprising, making a corrugated heat proof substrate, preparing a mixture containing effective amounts of dolomite, magnesite, white cement and water, overlaying said mixture on the top surface of said substrate, and causing said mixture to dry to form a hard overlaying layer having low thermal conductivity, low heat absorptivity and a high reflective index.

8. A method as claimed in claim 7, comprising, adding calcite to said mixture.

9. A method as claimed in claim 7, comprising, adding serpentine to said mixture.

10. A multilayered corrugated roofing as claimed in claim 3 wherein the roasted dolomite comprises between about 25 weight percent to about 35 weight percent of the dolomite constituent.

11. A multilayered corrugated roofing as claimed in claim 4 wherein the roasted magnesite comprises between about 25 weight percent to about 35 weight percent of the magnesite constituent.

12. A multilayered corrugated roofing as claimed in claim 1 wherein said coherent substance includes roasted dolomite wherein the roasted dolomite comprises between about 25 weight percent and about 35 weight percent of the dolomite constituent, and roasted magnesite wherein the roasted magnesite comprises between about 25 weight percent and about 35 weight percent of the magnesite constituent.

13. A multilayered corrugated roofing as claimed in claim 1 wherein said dolomite, magnesite and white cement are contained in the coherent substance in substantially equal amounts.

14. A method of making a multilayered corrugated roofing as claimed in claim 7 wherein the dolomite constituent comprises between about 25 weight percent to about 35 weight percent roasted dolomite.

15. A method of making a multilayered corrugated roofing as claimed in claim 7 wherein the magnesite constituent comprises between about 25 weight percent to about 35 weight percent roasted magnesite.

16. A multilayered corrugated roofing comprising:
(a) a substrate made of resin impregnated glass fibers and asbestos, and
(b) a dried overlaying layer formed of a coherent substance made of effective amounts of magnesite, calcium oxide, magnesium oxide, and white cement.

* * * * *